US005238314A

United States Patent [19]

Kitahara et al.

[11] Patent Number: 5,238,314

[45] Date of Patent: Aug. 24, 1993

[54] TRANSFER PRINTER WITH RIBBON LOCK

[75] Inventors: Satoshi Kitahara, Mishima; Shuji Koyama, Ito; Tsugio Shiozaki, Susono, all of Japan

[73] Assignee: Tokyo Electric Co., Ltd., Tokyo, Japan

[21] Appl. No.: 968,089

[22] Filed: Oct. 28, 1992

Related U.S. Application Data

[62] Division of Ser. No. 728,238, Jul. 10, 1991, Pat. No. 5,180,236.

[30] Foreign Application Priority Data

Jul. 13, 1990 [JP] Japan ..... 2-186884
Jul. 13, 1990 [JP] Japan ..... 2-186886

[51] Int. Cl.[5] ..... B41J 35/28

[52] U.S. Cl. ..... 400/208; 400/208.1; 400/120

[58] Field of Search ..... 400/207, 208, 208.1, 400/196.1, 120, 246, 692

[56] References Cited

U.S. PATENT DOCUMENTS

| | | | |
|---|---|---|---|
| 4,423,974 | 1/1984 | Muller | 400/242 |
| 4,534,666 | 8/1985 | Watanabe . | |
| 4,632,585 | 12/1986 | Oyamatsu | 400/613 |
| 4,641,980 | 2/1987 | Matsumoto et al. . | |
| 4,673,304 | 6/1987 | Liu | 400/208 |
| 4,720,202 | 1/1988 | Kawakimi | 400/208 |
| 4,754,290 | 2/1988 | Kitaykma et al. | 400/208 |
| 4,776,714 | 10/1988 | Sugiura | 400/248 |
| 4,797,690 | 1/1989 | Takita | 346/105 |
| 4,822,189 | 4/1989 | Dobring et al. | 400/208 |
| 4,855,755 | 8/1989 | Aizawa . | |
| 4,934,847 | 6/1990 | Shiozani et al. | 400/120 |
| 4,944,619 | 7/1990 | Suzuki et al. . | |
| 4,962,392 | 10/1990 | Okuno . | |
| 4,984,915 | 1/1991 | Tashiro et al. | 400/613 |
| 5,051,009 | 9/1991 | Sugiura et al. | 400/208 |
| 5,061,100 | 10/1991 | Brouwer | 400/642 |
| 5,064,300 | 11/1991 | Kashiwaba . | |
| 5,106,215 | 4/1992 | Kitahara et al. . | |
| 5,174,667 | 12/1992 | Sugimoto et al. | 400/207 |

FOREIGN PATENT DOCUMENTS

| | | |
|---|---|---|
| 0267890 | 5/1988 | European Pat. Off. . |
| 60-172570 | 9/1985 | Japan . |
| 61-68275 | 4/1986 | Japan . |

*Primary Examiner*—Eugene H. Eickholt
*Attorney, Agent, or Firm*—Frishauf, Holtz, Goodman & Woodward

[57] ABSTRACT

A label printer comprises a supporting frame having a pair of side plates facing each other. A print head and a platen roller are arranged between the side plates. Above the print head is arranged a ribbon supply device for running a transfer ribbon between the print head and the platen roller. The ribbon supply device includes a ribbon drive section, and a ribbon unit supported on a supporting member and movable between a first position wherein the unit engages the drive section and a second position wherein the unit is located outside the supporting frame. A fixing member is attached to one of the side plates and movable between a release position wherein the fixing member allows the ribbon unit to move and a fixing position wherein the fixing means engages the ribbon unit to hold it in the first position.

10 Claims, 15 Drawing Sheets

TRANSFER PRINTER WITH RIBBON LOCK

This is a division of application Ser. No. 07/728,238 filed Jul. 10, 1991 now U.S. Pat. No. 5,180,236.

BACKGROUND OF THE INVENTION

1. Field of the Invention

The present invention relates to a transfer printer in which ink on a transfer ribbon in contact with printing paper is transferred to the paper by means of a print head, thereby effecting printing.

2. Description of the Related Art

Transfer printers are used, for example, as label printers for printing item names, bar codes, etc. on labels. The label printer comprises a printing section which includes a platen roller and a line thermal head adapted to be pressed against the roller. A supply shaft and a take-up shaft for a transfer ribbon are located over the printing section. When the take-up shaft is rotated by means of a motor and the like, the transfer ribbon is fed out from the supply shaft, transported past a guide shaft and the printing section, and taken up by means of the take-up shaft. The supply shaft is connected with a load mechanism. A desired back tension is applied to the transfer ribbon by damping the rotation of the supply shaft by means of the load mechanism.

Conventionally, attaching and detaching operations for replacing the transfer ribbon must be performed in a narrow space within the printer body, while avoiding interfering with other components, so that the working efficiency is not very high. Similarly the thermal head must be attached or detached for replacement or cleaning in a narrow slice within the printer body, while avoiding interfering with the other components, so that the working efficiency is low.

Thereupon, a printer of a novel design has recently been developed to facilitate the replacement of the transfer ribbon. In this printer, a supply shaft and a take-up shaft wound with a ribbon are housed in a casing to form a modular structure or unit, which is removably mounted in the body of the printer. According to this arrangement, the transfer ribbon can be replaced outside the printer by removing the unit from the printer body. Also, a printer is proposed in which a thermal head is supported so that it can be drawn out of the printer body.

If the transfer ribbon and the supply and take-up shafts are combined into the unit, the replacement of the ribbon itself can be facilitated indeed. Nevertheless, the ribbon unit must be attached to or detached from the printer in the narrow space within the printer body, so that the working efficiency is not satisfactory.

If the ribbon unit and the thermal head are arranged so as to be removable from the printer body, they are lower in mounting strength than fully fixed ones, and will shake in the printer body during printing operation. Thus, the transfer ribbon may meander or be wrinkled, so that high print quality cannot be ensured.

SUMMARY OF THE INVENTION

The present invention has been contrived in consideration of these circumstances, and its object is to provide a transfer printer which permits easy maintenance of a transfer ribbon, print head, etc., and ensures improved print quality.

In order to achieve the above object, a transfer printer according to an aspect of the present invention comprises: a main body; printing means including a print head and a platen facing the print head, which are arranged in the main body, for printing information on a recording medium transported between the print head and the platen; a ribbon supply device for running a transfer ribbon between the print head and the recording medium, the ribbon supply device including a ribbon unit, having the transfer ribbon and a supply shaft and a take-up shaft wound with the transfer ribbon, and a ribbon drive section arranged in the main body, for driving the ribbon unit; supporting means arranged in the main body, for supporting the ribbon unit so that the ribbon unit is movable between a first position in which the ribbon unit engages the ribbon drive section and a second position in which the ribbon unit is disengaged from the ribbon drive section; and a fixing member provided on the main body so as to be movable between a release position in which the ribbon unit is allowed to move and a fixing position in which the fixing member engages the ribbon unit to hold the ribbon unit in the first position.

According to the printer constructed in this manner, the ribbon unit can be taken out of the main body by only being moved from the first position to the second position by means of the supporting means. In this state, the transfer ribbon can be replaced with a new one. If the ribbon unit is arranged so as to be removable from the supporting means, in this case, the replacement of the transfer ribbon can be further facilitated. After the ribbon replacement, the ribbon unit is moved to the first position by means of the supporting means, and is caused to engage the ribbon drive section. Thus, the ribbon unit can be easily mounted in the printer. As the fixing member is moved to the fixing position, moreover, the ribbon unit engages the fixing member, and is held in the first position. Thus, the ribbon unit can be held in the predetermined position without play, so that the print quality can be improved.

A printer according to another aspect of the present invention comprises: a main body including first and second supporting sections facing each other; a platen extending between the first and second supporting sections; a head unit including a print head; a supporting member having a fixed end fixed to the first supporting section and a free end extending close to the second supporting section the supporting member supporting the head unit in an operative position in which the print head is opposed to the platen so that the head unit is movable along the supporting member in the longitudinal direction of the platen, from the operative position to the outside of the main body; fixing means attached to the second supporting section so as to be movable between a release position in which the head unit is allowed to move and a hold position in which the fixing means engages and supports the free end of the supporting member; and holding means for holding the head unit, supported by the supporting member, in the operative position.

According to the printer constructed in this manner, the print head can be attached to or detached from the main body by only moving the head unit along the supporting member in the main body. After the head unit is mounted in the operative position in the main body, the supporting member is supported at both ends, having its free end supported by means of the fixing means. Further, the head unit is held in the operative position and prevented form moving by means of the holding means. Accordingly, the head unit can enjoy an improved mounting strength when it is mounted in the printer body, and the print head can be prevented from shaking. Thus, the print quality can be improved.

Additional objects and advantages of the invention will be set forth in the description which follows, and in part will be obvious from the description, or may be learned by practice of the invention. The objects and advantages of the invention ma be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description give above and the detailed description of the preferred embodiments given below, serve to explain the principles of the invention.

FIGS. 1 to 19B show a label printer according to an embodiment of the present invention, in which FIG. 1 is a perspective view showing an external appearance of the printer, FIG. 2 is a front view of the printer with its casing off, FIG. 3 is a side view, partially in section, showing the printer with its casing off, FIG. 4 is an exploded perspective view showing the principal mechanism of the printer, FIG. 5 is a front view corresponding to FIG. 2, in which a ribbon unit is off, FIG. 6 is an exploded perspective view showing the ribbon unit and a supporting mechanism, FIG. 7 is a perspective view showing the supporting mechanism in an extended state, along with part of the ribbon unit, FIG. 8 is a sectional view taken along line VIII—VIII of FIG. 6, FIG. 9 is a plan view of the ribbon unit, FIG. 10 is a front view of a shaft end portion.

FIG. 12 is a perspective view showing the principal part of the printer with its head unit off;

FIG. 13 is an enlarged perspective view showing one end portion of the head unit;

FIG. 14 is a sectional view taken along line XIV—XIV of FIG. 13;

FIG. 15 is a sectional view taken along line XV—XV of FIG. 13;

FIG. 16 is a perspective view showing the principal part of the printer with its fixing plate disengaged;

FIG. 17 is a perspective view showing the principal part of the printer with its fixing plate engaged;

FIGS. 19A and 19B are schematic plan views individually showing different states of engagement between an engaging pin and an engaging hole.

DETAILED DESCRIPTION OF THE PREFERRED EMBODIMENTS

An embodiment, in which a transfer printer according to an embodiment of the present invention is applied to a label printer, will now be described in detail with reference to the accompanying drawings.

Figure 1:
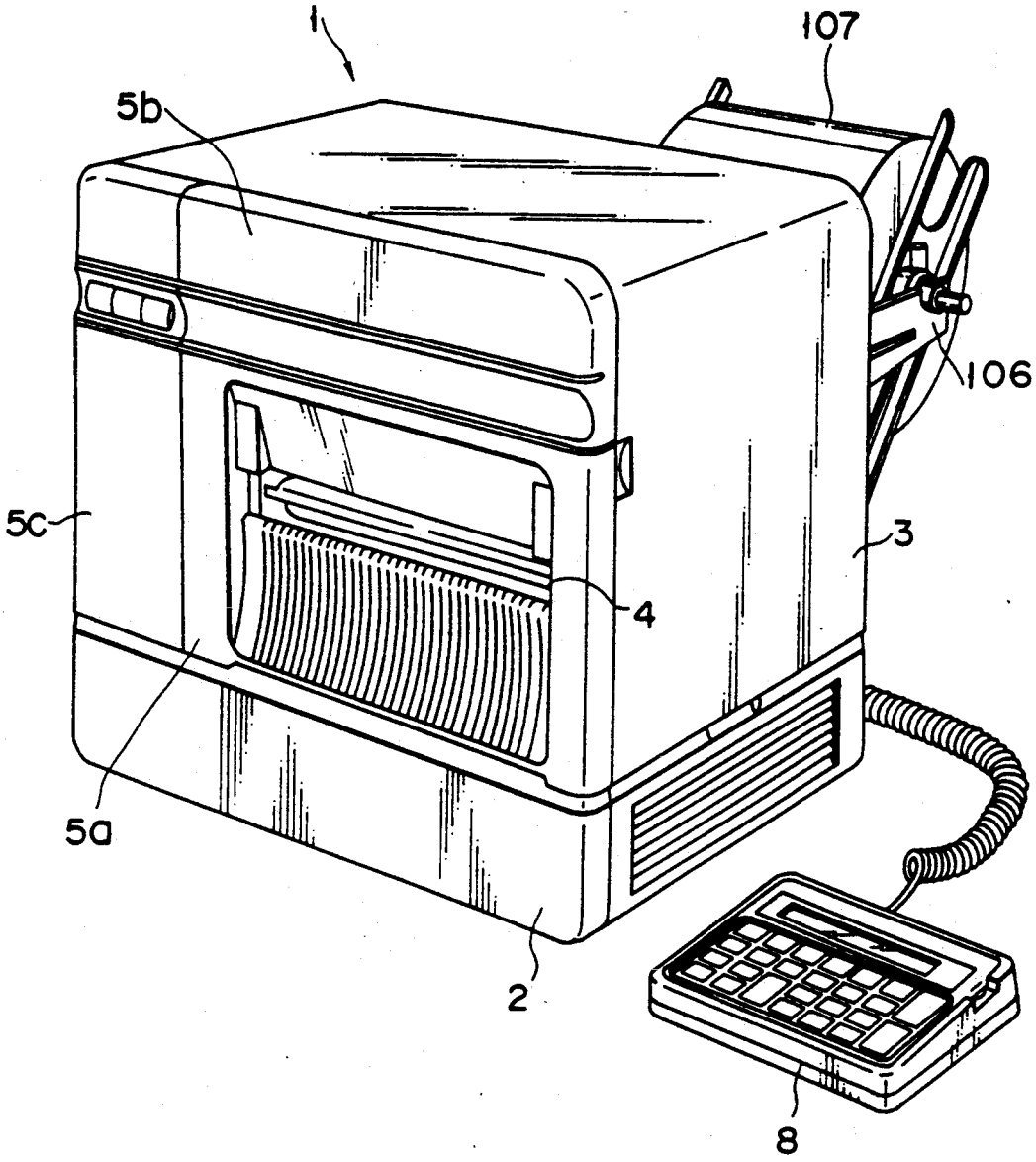
Figure 2:
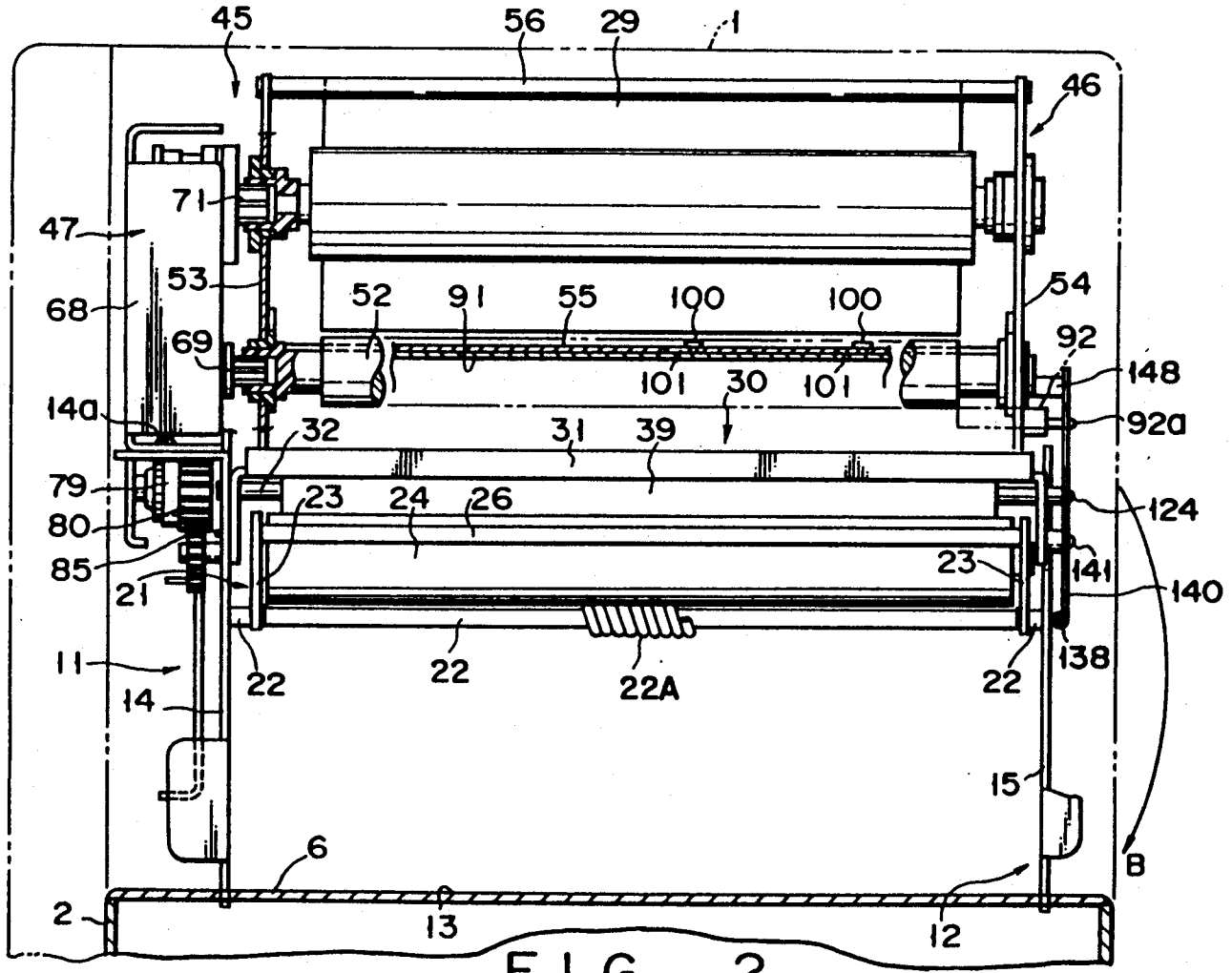
Figure 3:
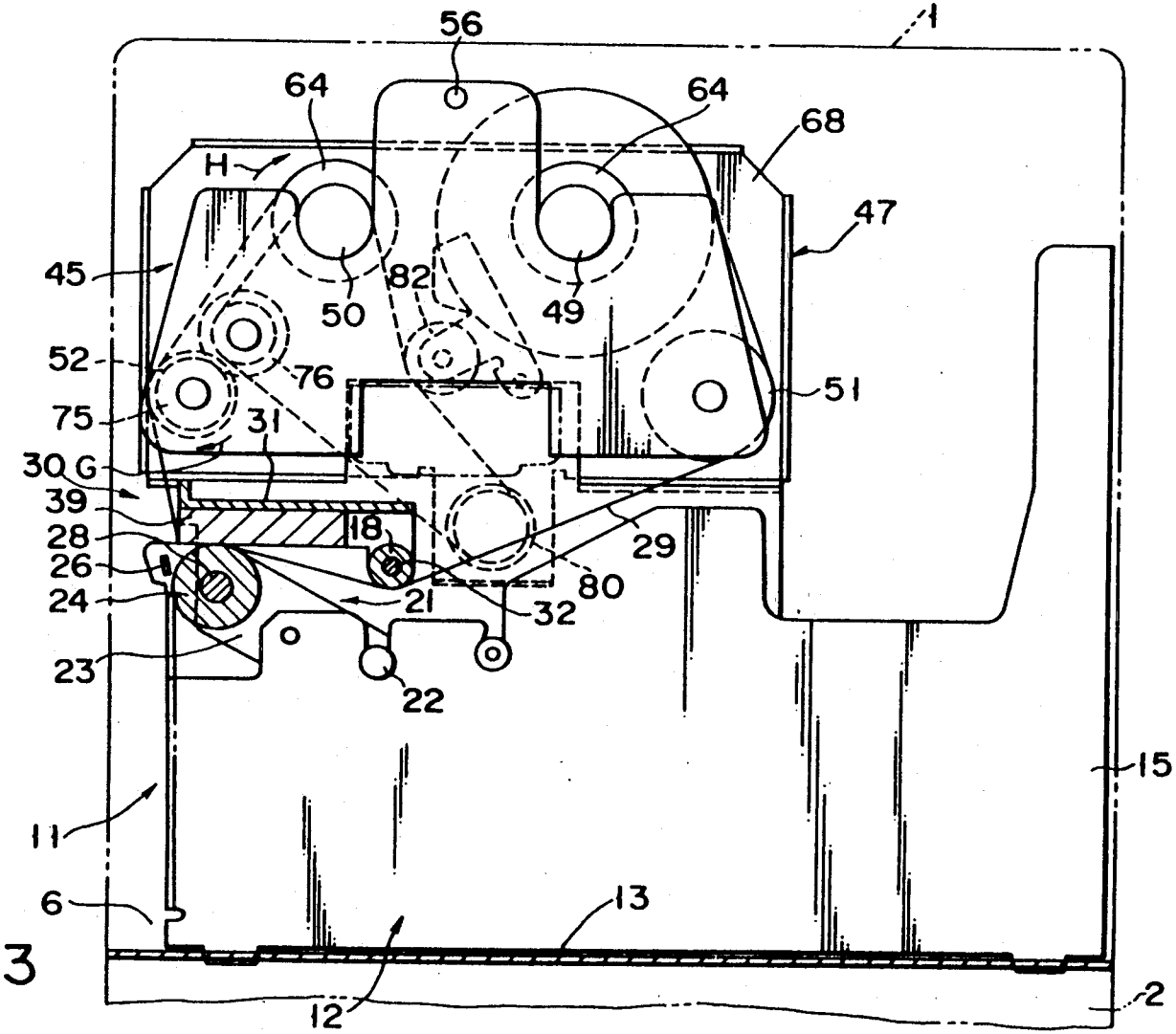

As shown in FIGS. 1 to 3, the label printer has a body casing 1 in the form of a substantially rectangular box. The casing 1 includes a rectangular base 2, a U-shaped side panel 3 having a pair of side walls and a top wall, integral with one another, and removably mounted on the base 2, and an L-shaped first front panel **5*a* removably mounted on the base 2 and having an outlet port 4 through which printed paper is discharged. The casing 1 further includes a second front panel 5*b* formed integrally with the side panel 3 so as to be continuous with the upper portion of the first front panel 5*a*, and a third front panel 5*c* fixed to the base 2 and situated beside and continuous with the first and second front panels 5*a* and 5*b*. In FIG. 1, reference numeral 8** denotes a controller for entering print information into the printer.

A printing mechanism 11 is disposed in the body casing 1. The following is a description of the mechanism 11.

As shown in FIGS. 2 and 3, the printing mechanism 11 includes a body frame 12 which constitutes a main body of the printer in association with the casing 1. The frame 12 is formed of a horizontal bottom plate 13, fixed to the upper surface of the base 2 of the casing 1, and frame side plates 14 and 15 set up on the left and right end portions of the bottom plate, respectively, these plates being connected to one another. The two side plates 14 and 15 stand upright so as to face each other.

The printing mechanism 11 further includes a platen unit 21, which is located between the frame side plates 14 and 15 and rockably supported by the same. The unit 21 includes a support shaft 22, two end plates 23, and a platen roller 24.

The support shaft 22 extends substantially horizontally between the frame side plates 14 and 15. Both end portions of the shaft 22 are nonrotatably fixed to the side plates, respectively. The two end plates 23, which face each other, are each in the form of a flat plate, and are arranged adjacent to the side plates 14 and 15, respectively. The respective rear end portions of the end plates 23 are mounted on the support shaft 22 so as to be individually rockable around it.

A bearing (not shown) is mounted on the front end portion of each end plate 23. A platen shaft 28 of the platen roller 24 penetrates these bearings to be supported thereby. Thus, the roller 24 is stretched substantially horizontally between the respective front end portions of the two end plates 23. One end portion of the platen roller 24 is connected to a paper feeding mechanism (not shown) so that the roller 24 is driven in association with the feeding mechanism.

A torsion spring 22A (FIG. 2) is wound around the support shaft 22, and the whole structure of the platen unit 21 except the shaft 22 is urged upward by means of the urging force of the torsion spring. Thus, the platen roller 24 is upwardly pressed against a line thermal head 39. If necessary, e.g., at the time of loading or removal of a ribbon unit 46 (described later), the whole structure of the platen unit 21 except the support shaft 22 is rocked downward around the shaft 22 against the urging force of the torsion spring.

A head frame 31 is located above the platen unit 21. A line thermal head 39 is fixed to the lower surface of the front end portion of frame 31 and extends parallel to the platen roller 24. The roller 24 is pressed against the head 39 from under the same. As shown in FIG. 3, a guide roller 18 for guiding a transfer ribbon is rotatably mounted on a supporting shaft 32 which supports the head frame 31.

Figure 4:
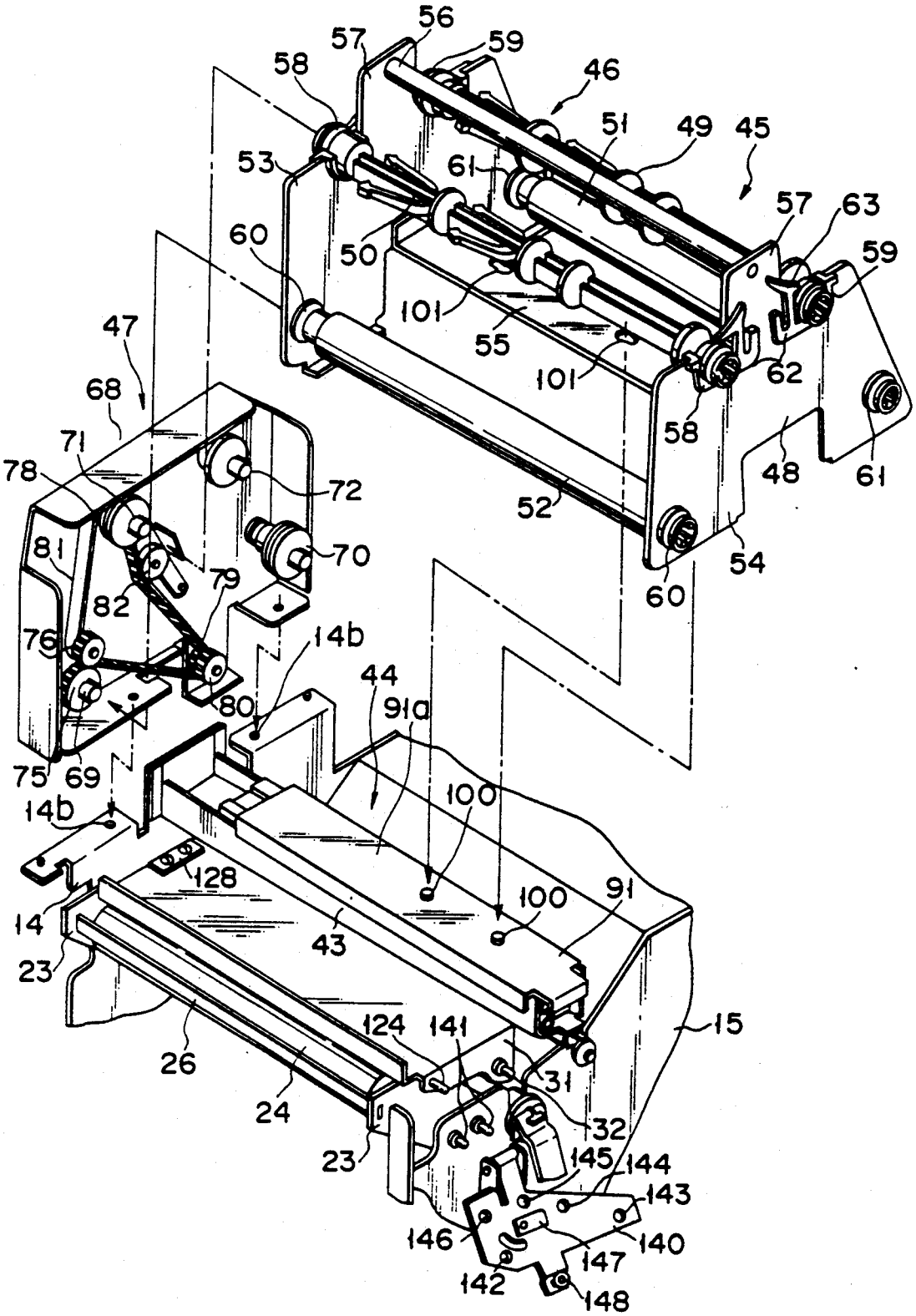
Figure 5:
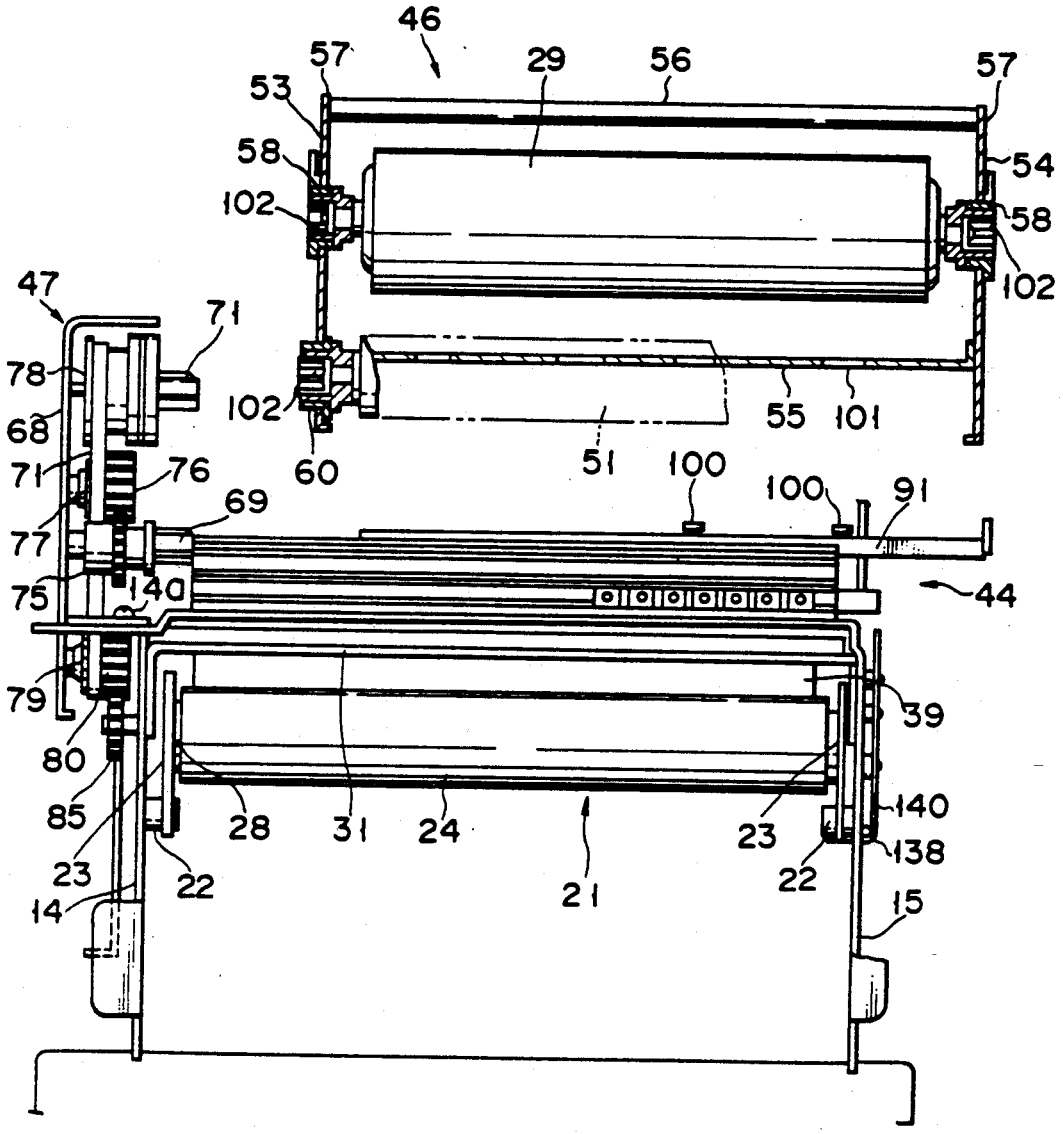
Figure 6:
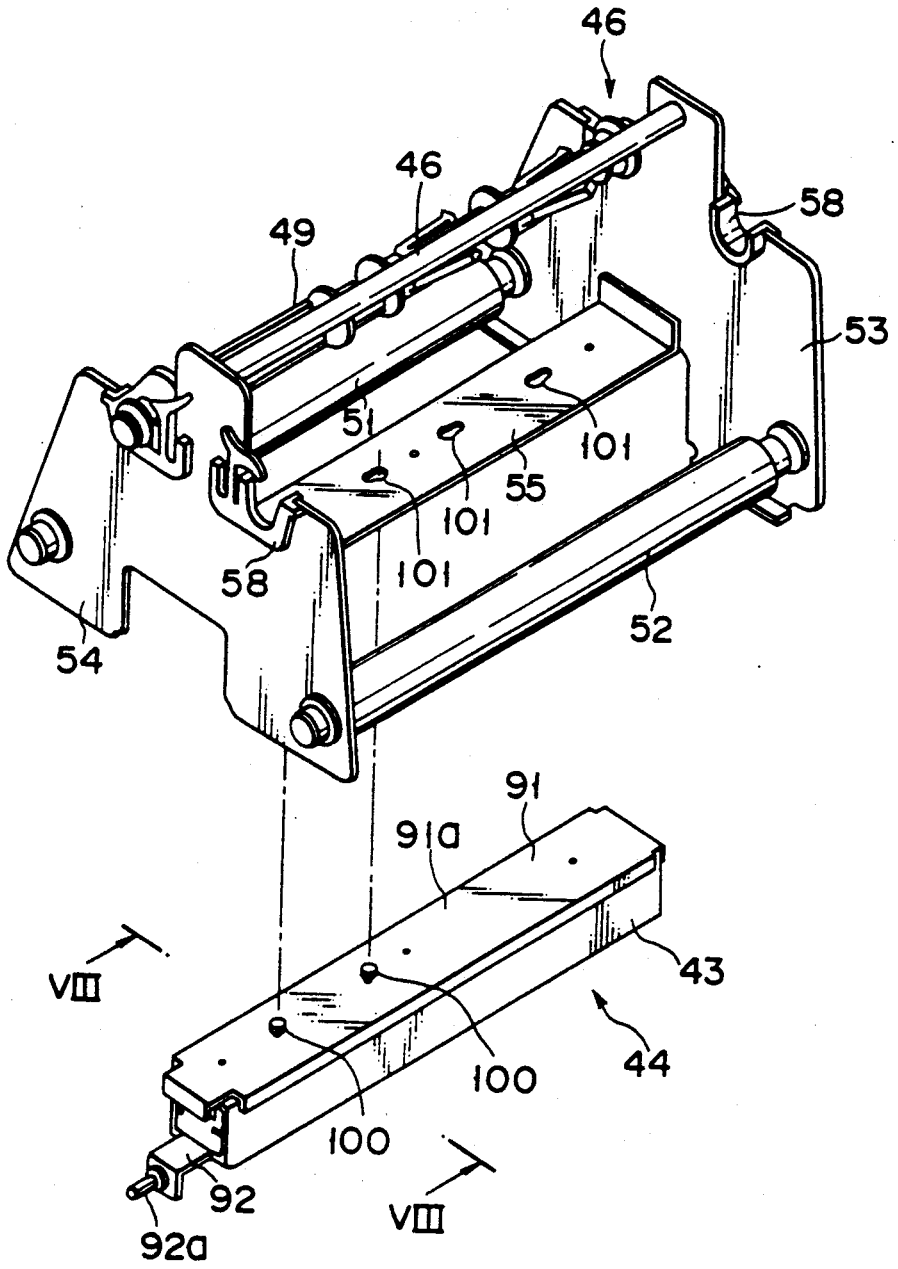
Figure 7:
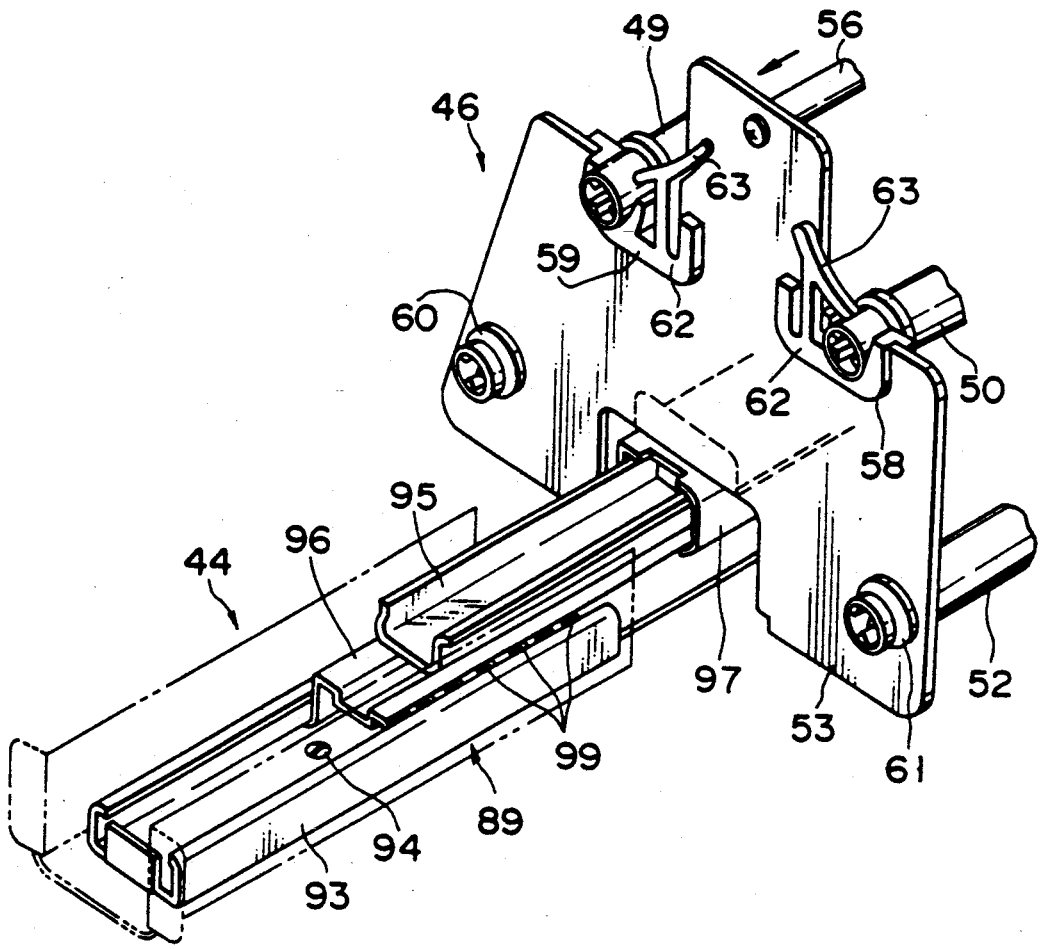
Figure 8:
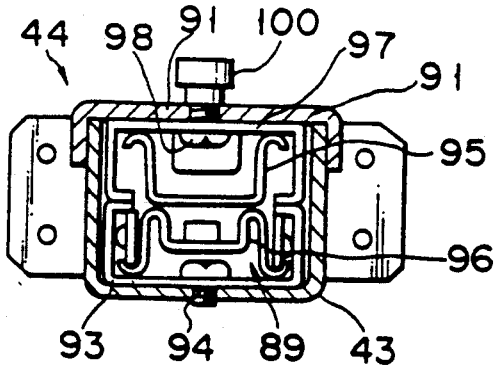

As shown in FIG. 4, a ribbon supporting mechanism 44 for supporting the ribbon unit 46 of a ribbon supply device 45 (mentioned later) is arranged above the head frame 31. The supporting mechanism 44 includes a fixed arm 43, which has a U-shaped cross section and extends parallel to the platen roller 24, and an elongated slider 91 mounted on the arm 43 so as to be slidable in the axial direction of the roller 24 by means of a guide mechanism 89. The ribbon unit 46 is removably mounted on the slider 91.

More specifically, one end of the fixed arm 43 is fixed to the frame side plate 14, while the other end extends close to the frame side plate 15. Thus, the arm 43 is supported like a cantilever. An L-shaped plate 92 protrudes from the distal end portion of the arm 43, and a supporting pin 92*a* protrudes from a vertical surface of the plate 92. The upper surface of the slider 91 extends parallel to the platen roller 24 or horizontally, and constitutes a supporting surface 91*a* on which the ribbon unit 46 is placed. The profile of the side plate 15 is lower than that of the side plate 14 so that the region facing the fixed arm 43 on the side of the plate 15 is open.

As shown in FIGS. 5 to 8, the guide mechanism 89 includes a lower rail 93, a pair of intermediate rails 95 and 96, and an upper rail 97. Extending parallel to the fixed arm 43, these rails are substantially as long as the arm 43. The lower rail 93 is fixed to the bottom of the fixed arm 43 by means of a screw 94. The intermediate rail 96 is inserted in the lower rail 93, and a large number of guide rollers 99 are arranged between the rails 93 and 96. Thus, the intermediate rail 96 is axially slidable with respect to the lower rail 93.

The intermediate rail 95 is fixed on the intermediate rail 96, and the upper rail 97 is slidably fitted on the rail 95. The slider 91 is fixed to the upper rail 97 by means of a pair of screws 98. Thus, the slider 91 is slidable between a first position shown in FIG. 4 and a second position. In the second position, the whole body of the slider 91 projects from the casing 1.

A pair of engaging pins 100 are fixed to the upper surface of the slider 91 by means of the screws 98. These pins 100 are situated at a predetermined distance from each other along the axial direction of the slider 91. The upper end portion of each pin 100 is greater in diameter than its lower end portion.

As shown in FIGS. 2 and 3, the ribbon unit 46 of the ribbon supply device 45 is removably mounted on the slider 91 of the supporting mechanism 44 in a straddling manner.

As shown in FIGS. 2 to 7, and 9, the ribbon unit 46 includes a ribbon supporting frame 48, a supply shaft 49, a take-up shaft 50, a tension shaft 51, and a ribbon drive shaft 52.

In the ribbon supporting frame 48, the respective bottom portions of a pair of opposite side plates 53 and 54 are connected to each other by means of a lower cross member 55, and lugs 57 protruding individually from the center of the respective top portions of the side plates 53 and 54 are connected to each other by means of an upper cross member 56. The upper cross member 56, which is formed of a round rod, serves as a carrying handle for the ribbon unit 46.

The lower cross member 55 is formed having two pairs of 8-shaped holes 101. The engaging pins 100 of the slider 91 individually engage one pair of holes 101, whereby the ribbon unit 46 is retained on the slider 91. The two pairs of holes 101 are arranged symmetrically with respect to the center of the lower cross member 55 as viewed in the longitudinal direction.

A pair of first upper bearings 58 are individually mounted facing each other on the respective upper portions of the side plates 53 and 54 and are situated in front of their corresponding lugs 57. Also, a pair of second upper bearings 59 are mounted facing each other at the back of the lugs 57. A pair of bearings 60 are individually mounted facing each other on the respective lower front portions of the side plates 53 and 54, while a pair of bearings 61 are mounted facing each other on the respective lower rear portions of the plates 53 and 54.

The bearings 58 and 59, which are formed of synthetic resin, each include an open-topped U-shaped bearing portion 62 and a hook portion 63 situated in close vicinity to the top of the portion 62. The proximal part of the hook portion 63 is thinned to enable elastic deformation. As this proximal part is elastically deformed, the hook portion 63 can move close to or away from the open top of the bearing portion 62.

Two opposite axial end portions 49*a* of the supply shaft 49 are rotatably supported individually by means of the second upper bearings 59 on the rear side of the ribbon supporting frame 48 so that the shaft 49 extends transversely between the two side plates 53 and 54. The shaft 49 is removably mounted on the bearings 59. More specifically, the hook portions 63 are pressed against the respective upper peripheral surfaces of their corresponding shaft end portions 49*a* of the supply shaft 49, which are supported by means of the bearings 59. Thus, the supply shaft 49 is prevented from being unexpectedly disengaged upward from the upper bearings 59. The supply shaft 49 can be removed from the frame 48 by being only manually pulled up. If the shaft 49 is drawn upward, the hook portions 63 undergo elastic deformation, so that the shaft end portions 49*a* are disengaged upward from their corresponding bearing portions 59. Thus, the ribbon set shaft 49 can be removed.

Shaft end portions 50*a* on the opposite sides of the take-up shaft 50 are rotatably supported individually by means of the first upper bearings 58 on the front side of the ribbon supporting frame 48 so that the shaft 50 extends transversely between the two side plates 53 and 54. The shaft 50 is removably mounted on the bearings 58. Since this take-up shaft 50 is attached and detached in the same manner as the supply shaft 49, a description of the procedure of operation for the attachment and detachment is omitted.

The supply and take-up shafts 49 and 50 are identical in size and shape. Thus, these shafts 49 and 50 can be mounted on the two pairs of bearings 58 and 59 on the ribbon supporting frame 48 while being replaced with each other in the aforementioned procedure of operation.

The supply and take-up shafts 49 and 50 and the two pairs of bearings 58 and 59, front and rear, are located symmetrically with respect to an imaginary plane H (see FIG. 9) which passes through the center of the ribbon unit 46, as viewed in the depth direction, or extends parallel between the shafts 49 and 50.

Each of the shafts 49 and 50 is removably fitted with cylindrical cores 64 on which a transfer ribbon 29 (mentioned later) are wound. The core 64 is provided at its one end with a notch in which a projection 119 (see FIG. 9) of the shaft is fitted to prevent the rotation of the core relative to the shaft. The ribbon 29 is wound around the core 64 supported on the supply shaft 49. After being drawn out from the shaft 49 and transported past the tension shaft 51 and the ribbon drive shaft 52 in succession, the ribbon 29 is reeled up onto the core 64 supported on the take-up shaft 50. That portion of the transfer ribbon 29 which extends between the tension shaft 51 and the ribbon drive shaft 52 passes between the platen roller 24 and the line thermal head 39 which constitute a printing section.

Shaft end portions 52*a* on the opposite sides of the ribbon drive shaft 52 are rotatably supported individually by means of the bearings 60 so that the shaft 52 extends transversely between the two side plates 53 and 54. Thus, the shaft 52 is situated between the printing section and the take-up shaft 50, on the front side of the head frame 31. The transfer ribbon 29 running from the printing section toward the take-up shaft 50 is wound around the outer circumferential surface of the ribbon drive shaft 52. That portion of the circumferential surface of the shaft 52 which is in contact with the ribbon 29 is formed of a material, e.g., rubber, which ensures a great force of friction with the ribbon 29.

Shaft end portions 51*a* on the opposite sides of the tension shaft 51 are rotatably supported individually by means of the bearings 61 so that the shaft 51 extends transversely between the two side plates 53 and 54. Thus, the shaft 51 is situated between the printing section and the supply shaft 49, on the rear side of the head frame 31. The transfer ribbon 29 running from the supply shaft 49 toward the printing section is wound around the outer peripheral surface of the tension shaft 51. The circumferential surface of the shaft 51, which is in contact with the ribbon 29, is also formed of rubber or other high-friction material.

The tension shaft 51 has the same size and shape as the ribbon drive shaft 52. The shafts 51 and 52 and the two pairs of bearings 60 and 61, front and rear, are located symmetrically with respect to the aforesaid imaginary plane H. Thus, the four rotatable shafts 49, 50, 51 and 52 on the ribbon supporting frame 48 are arranged symmetrically with respect to the center P (extending at right angles to the shafts 49 to 52, on the imaginary plane H of FIG. 9) of the ribbon unit 46.

Figure 10:
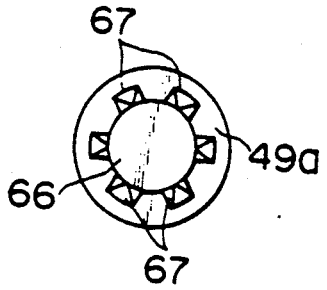

Each of the shaft end portions 49*a*, 50*a*, 51*a* and 52*a* is formed having a connecting hole 66. With respect to the shaft end portion 49*a*, by way of example, six grooves 67 are formed at regular intervals in the inner circumferential surface of the connecting hole 66 so as to extend in the axial direction, as shown in FIG. 10.

Referring now to FIGS. 2 to 5, a ribbon drive section 47 will be described. This drive section 47 includes a rectangular base 68 whose side edge portions are bent at right angles. A horizontal plate portion of the base 68 on the lower side is fixed to the upper surface of the end portion of the frame side plate 14 by means of screws 14*a*. Four rotating shafts 69, 70, 71 and 72 protrude horizontally from a vertical plate portion of the base 68. The shafts 69, 70, 71 and 72 are arranged corresponding to the shafts 52, 51, 50 and 49, respectively, of the ribbon unit 46.

A gear 75 is mounted coaxially on the rotating shaft 69 at the lower front portion of the base 68, and a gear 76 is in mesh with the gear 75. A toothed pulley 77 is mounted coaxially on the gear 76. A pulley 78 is integrally provided on the rotating shaft 71 at the upper front portion of the base 68, and a toothed pulley 79 and a driving gear 80 are arranged coaxially in the center of the lower portion of the base 68. A timing belt 81 is passed around and between the pulleys 77, 78 and 79. A tension roller 82 is pressed against the belt 81, thereby applying a tension to the belt 81.

The driving gear 80 is in mesh with a gear 85 of a drive system for the platen roller 24. Thus, the ribbon drive section 47 is driven in synchronism with the roller 24.

Figure 11A:
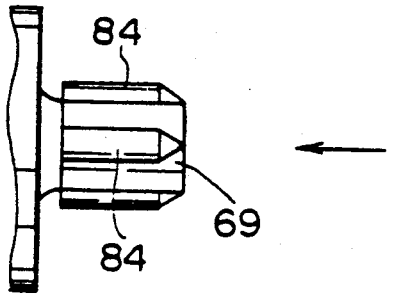
FIG. 11A is a side view of a rotating shaft end portion.
Figure 11B:
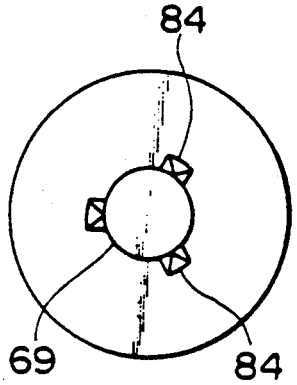
FIG. 11B is a front view of the rotating shaft end portion.
Figure 9:
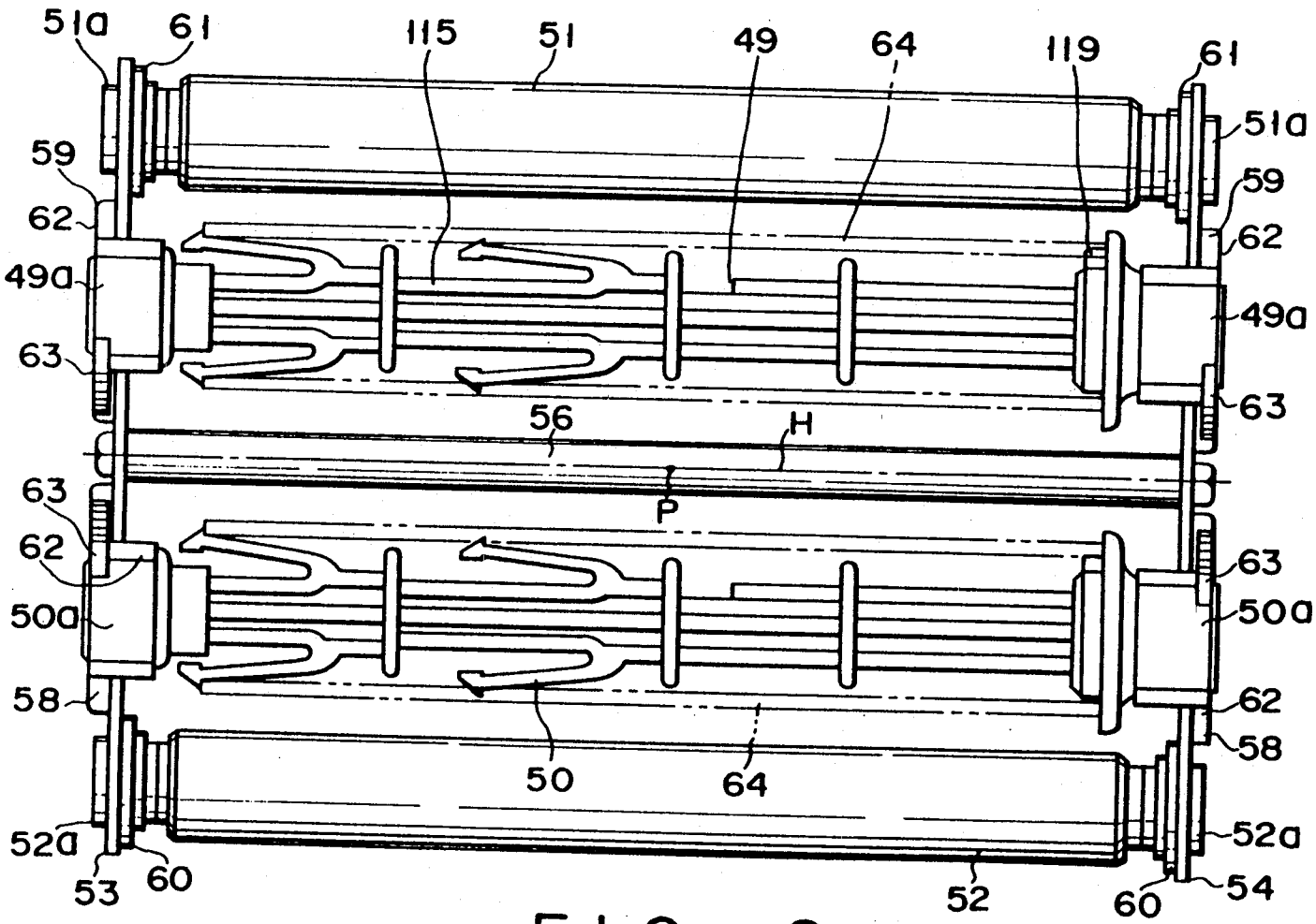

As shown in FIGS. 11C and 11D, each of the rotating shafts 69, 70, 71 and 72 has three axial projections 84 on its outer circumferential surface. The projections 84 are caught between the projections 104 in the connecting hole, thereby transmitting drive force to the projections 104. The tip end portion of each projection 84 is also tapered.

Figure 12:
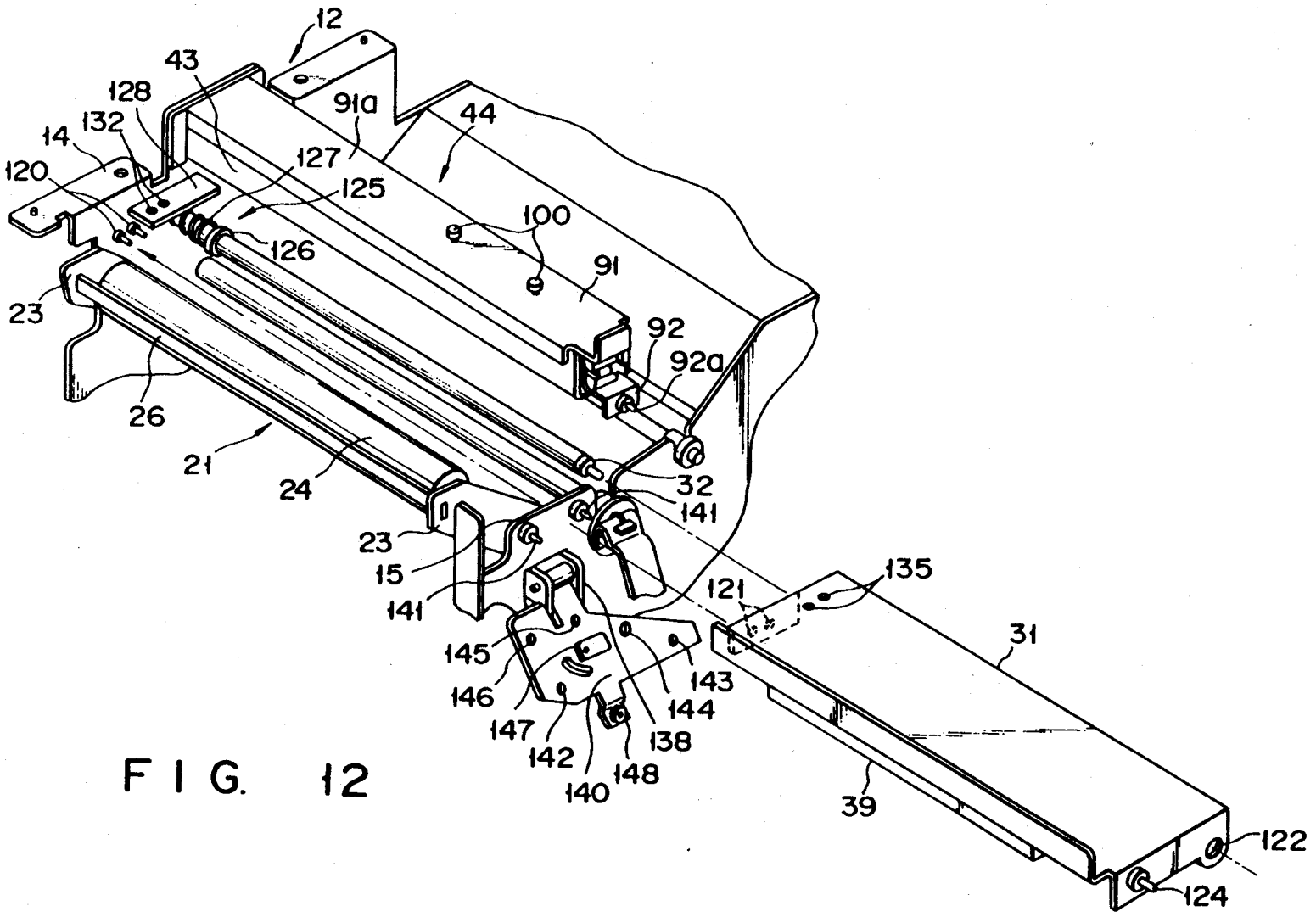
Figure 13:
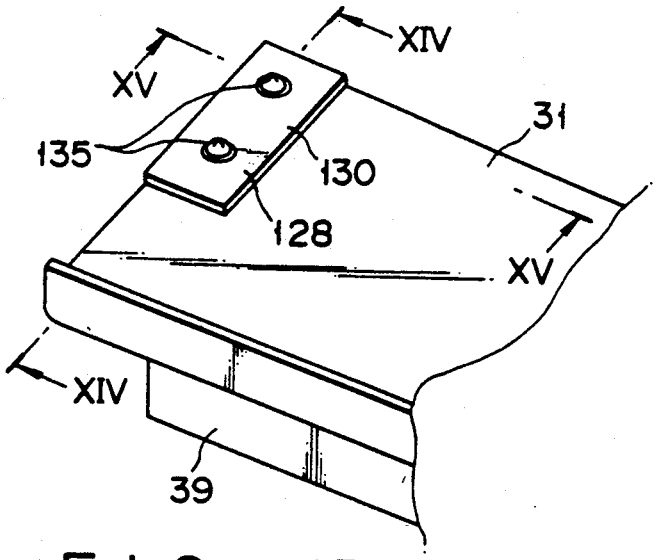
Figure 14:
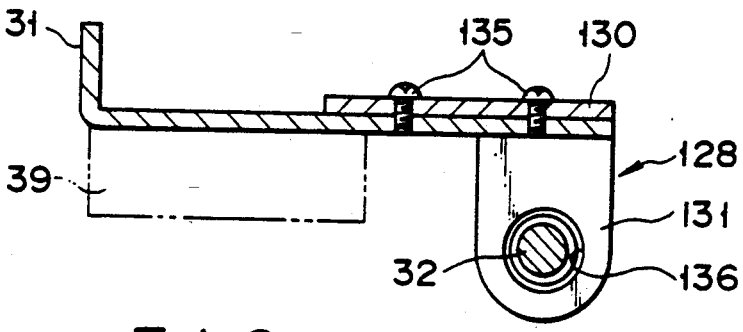
Figure 15:
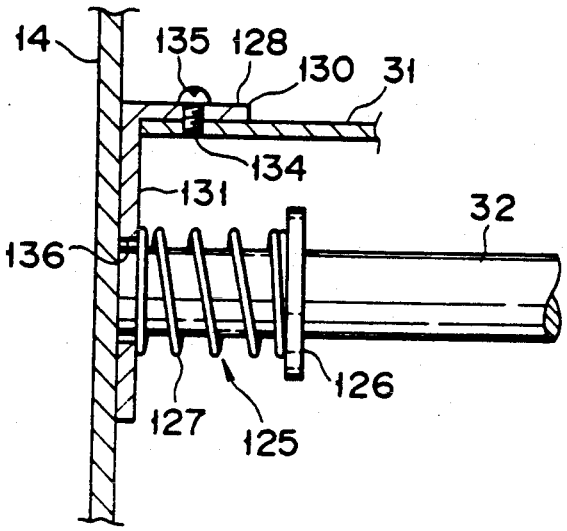

A head unit 30 is mounted by means of a mounting structure shown in FIG. 12. One end portion of the supporting shaft 32 for use as a supporting member is fixed to the one frame side plate 14 of the body frame 12. Thus, the shaft 32 is supported like a cantilever. The supporting shaft 32 extends parallel to the platen roller 24, and its free end overlies the side plate 15 and outwardly projects a short distance from the body frame 12. A pair of positioning pins 120 protrudes from the frame side plate 14. A pair of positioning holes 121 to mate with the pins 120 are formed in that side wall of the head frame 31 on the side of the side plate 14. Also, the other side wall of the frame 31 on the side of the side plate 15 is formed having an engaging hole 122 therein and a fixing pin 124 outwardly protruding therefrom. The supporting shaft 32 is passed through the hole 122. The head unit 30 is supported like a cantilever in a manner such that the shaft 32 is slidably passed through the engaging hole 122, and the positioning pins 120 ar fitted individually in the positioning holes 121.

A holding mechanism 125 for holding the head frame 31 in a predetermined position on the supporting shaft 32 is provided at the fixed end portion of the shaft 32. As shown in FIGS. 12 to 15, the mechanism 125 includes an E-ring 126 fixed to the fixed end portion of the supporting shaft 32, a coil spring 127 wound around the shaft 32 and having one end fixed to the ring 126, and a head supporting plate 128 fixed to the other end of the spring 127. The supporting plate 128 includes a horizontal portion 130 and a vertical portion 131. A pair of through holes 132 are formed in the horizontal portion 130, while a pair of tapped holes 134 corresponding to the holes 132 are formed in that end portion of the head frame 31 on the side of the frame side plate 14. The supporting plate 128 is fixed to the frame 31 by screwing screws 135 into the holes 134 through the holes 132. Meanwhile, the vertical portion 131 is formed having a through hole 136, through which the proximal end portion of the supporting shaft 32 is passed. The vertical portion 131 is pressed against the frame side plate 14 by means of the coil spring 127. Thus, the head frame 31 is kept pressed against the plate 14 by means of the holding mechanism 125, whereby it is restrained from moving.

Figure 16:
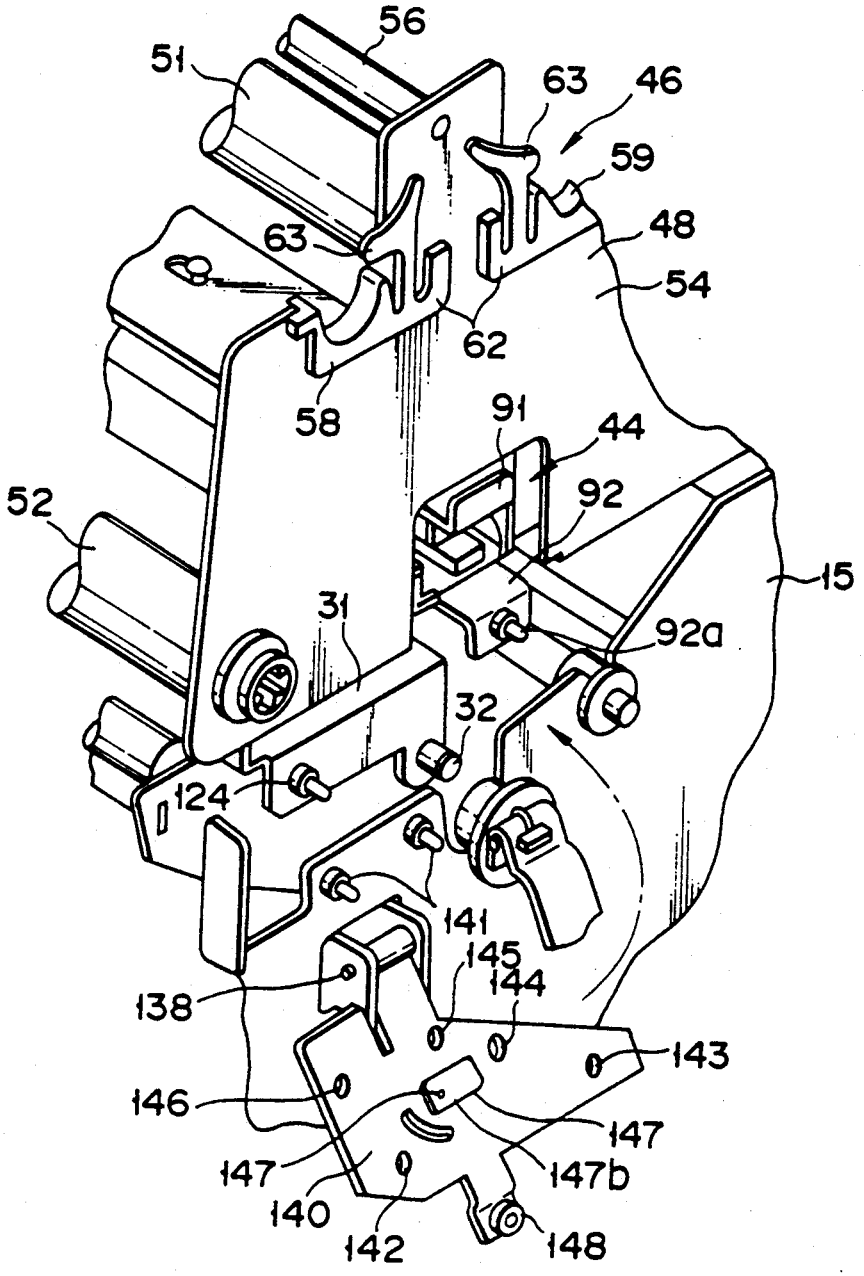

As shown in FIGS. 12 and 16, moreover, a fixing plate 140 is rockably mounted on the outer surface of the other frame side plate 15 of the body frame 12 by means of a hinge 138. Also, a pair of positioning pins 141 protrude from the outer surface of the plate 15 so as to be situated above the hinge 138. The fixing plate 140 has first to fifth engaging holes 142, 143, 144, 145 and 146, and is provided with a lock mechanism 147.

Figure 17:
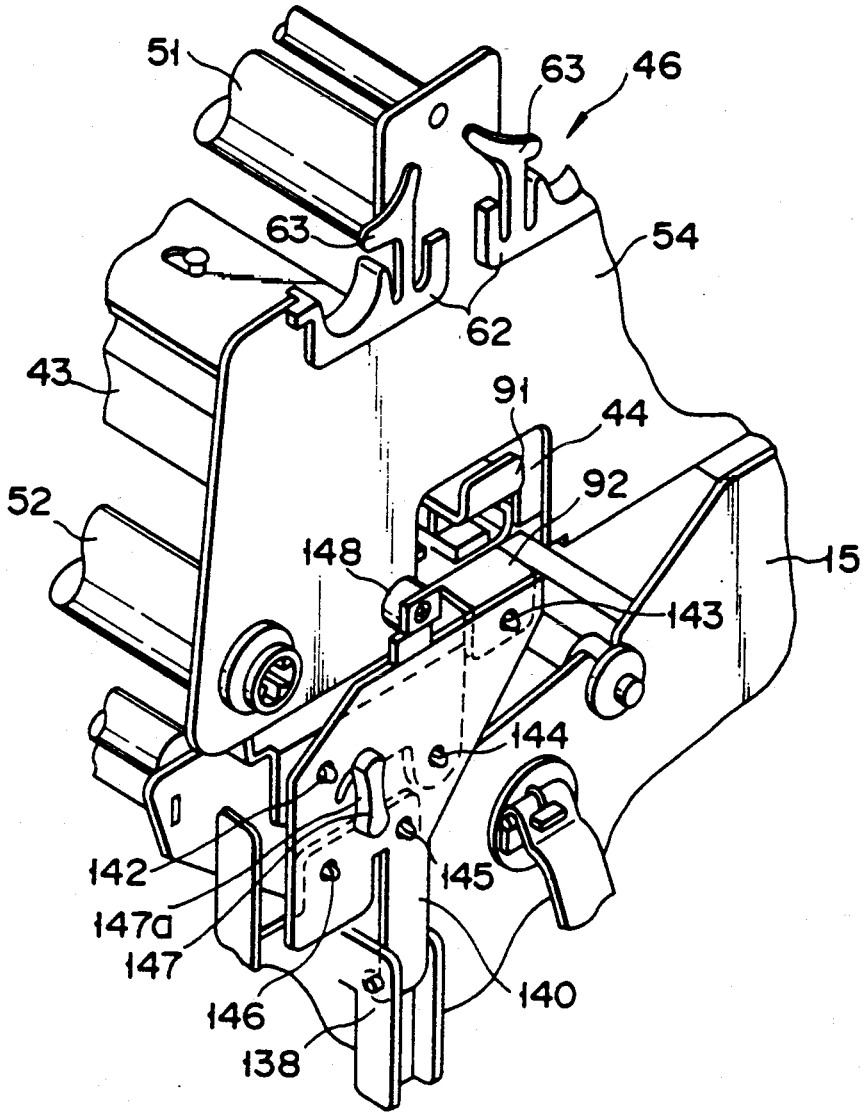

As the fixing plate 140 is rocked upward around the hinge 138, from a release position shown in FIG. 12 to a fixing position shown in FIG. 17, the fixing pin 124 of the head frame 31 is fitted into the first engaging hole 142, while the fixing pin 92*a*, which is attached to the distal end of the fixed arm 43 of the ribbon guide mechanism, is fitted into the second engaging hole 143. Further, the free end of the supporting shaft 32, one of the fixing pins 141 and the other fixing pin 141 engage the third, fourth, and fifth engaging holes 144, 145 and 146, respectively. In this manner, the free end of the supporting shaft 32, that end of the head frame 31 on the side of the side plate 15, and the free end of the fixed arm 43 are supported by means of the fixing plate 140. Thus, the shaft 32, the frame 31, and the arm 43 are supported at both ends.

The lock mechanism 147 includes a knob 147*a* rotatably mounted on the outside of the fixing plate 140 and a lock piece 147*b* rotatably mounted on the inside of the plate 140. The piece 147*b* is connected to the knob 147*a* by means of a pivot 147*c*. As the knob 147*a* rocks, the lock piece 147*b* rocks around the pivot 147*c*. When the knob 147*a* is rocked with the fixing plate 140 in the fixing position, the lock piece 146*b* engages the upper end portion of the frame side plate 15, so that the plate 140 is locked to the fixing position.

An elastic member, e.g., a rubber fixing bush 148, is fixed to the inside of the distal end portion of the fixing plate 140. When the fixing plate 140 is rocked to the fixing position with the ribbon unit 46 connected to the ribbon drive section 47, the bush 148 is pressed against the side plate 54 of the unit 46, thereby restraining the unit 46 from moving away from the drive section 47.

In the thermal printer with this construction, the transfer ribbon 29 is set in the following manner, with the side panel 3 (see FIG. 1) off the body casing 1.

First, the knob 147*a* of the fixing plate 140 is rocked to disengage the lock piece 147*b* from the upper end portion of the frame side plate 15. Then, the fixing plate 140 is disengaged from the supporting shaft 32, the head frame 31, and the fixed arm 43 of the guide mechanism by being rocked downward in the direction of arrow B of FIG. 2 to the release position. As a result, the head frame 31 and the fixed arm 43 are released from the support on the side of the side plate 15. Thus, the ribbon unit 46 and the head unit 30 are allowed to be removed.

Then, the platen roller 24 is moved downward to be separated from the thermal head 39 by the use of drive means (not shown), and the slider 91 of the ribbon supporting mechanism 44 is pulled. Thereupon, the upper rail 97 and the intermediate rails 95 and 96 are slidingly drawn out, and the slider 91 is drawn out from the casing 1.

Figure 18A:
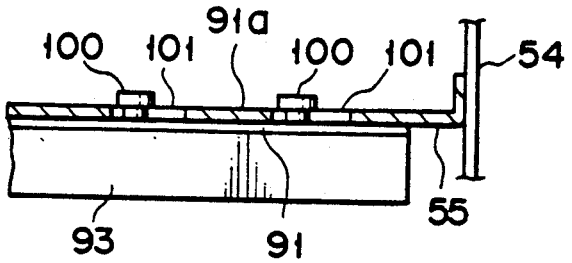
FIGS. 18A and 18B are schematic views showing different states of connection between the ribbon unit and a slider.
Figure 18B:
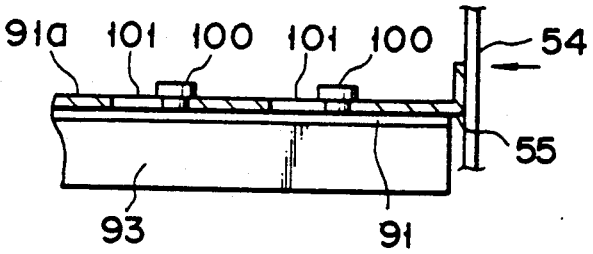
Figure 19A:
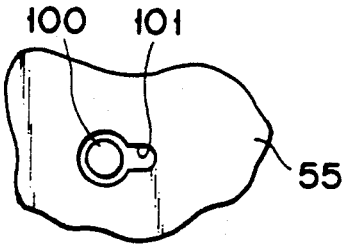
Figure 19B:
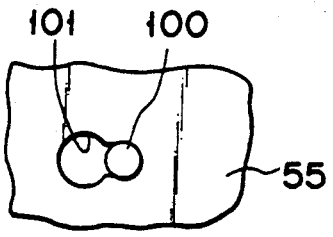

Subsequently, the transfer ribbon 29 is set on the ribbon supporting frame 48, and that portion of the ribbon situated between the tension shaft 51 and the ribbon drive shaft 52 is drawn downward to form a small sag. In this state, the drawn-out portion of the ribbon 29 is passed through the slider 91, and the ribbon unit 46 is then mounted on the slider 91. In mounting this unit 46, the lower cross member 55 is first placed on the slider 91 in a manner such that the engaging pins 100 of the slider are inserted individually in the respective large-diameter portions of their corresponding 8-shaped holes 101 of the cross member 55, as shown in FIGS. 18A and 19A. Thereafter, the ribbon unit 46 is moved in the direction of the arrow of FIG. 18B toward the casing 1. Thereupon, the head portion of each pin 100 engages the small-diameter portion of its corresponding hole 101, as shown in FIG. 19B, so that the ribbon unit 46 is retained on the slider 91.

After being held in position in this manner, the ribbon unit 46, along with the slider 91, is pushed into the body casing 1 of the printer. As a result, the slider 91 is moved to the first position, and the ribbon unit 46 is housed in the body casing 1. The respective connecting holes 66 of the shafts 49, 50, 51 and 52 of the unit 46 are fitted on the rotating shafts 72, 71, 70 and 69, respectively, of the ribbon drive section 47, which is fixed on the side plate 14. Thus, the drive section 47 and the ribbon unit 46 are connected to each other.

The sagging portion of the transfer ribbon 29 is passed between the platen roller 24 and the line thermal head 39 which are separated from each other. In this state, the surplus portion of the ribbon 29 is taken up by manually turning the take-up shaft 50. Then, paper pasted with a large number of labels is drawn out from a paper roll 107, which is set on a paper holder 106 (see FIG. 1) attached to the rear face of the body casing 1, and is introduced into the casing 1 through the rear face thereof. This paper is passed between the roller 24 and the head 39 separated from each other, in a region under the transfer ribbon 29. Thereafter, the platen roller 24 is rocked upward to come into contact with the thermal head 39.

The fixing plate 140 is rocked to the fixing position with the ribbon unit 46 connected to the ribbon drive section 47. Thereupon, the fixing pin 124 of the head frame 31 is fitted into the first engaging hole 142 of the plate 140, while the fixing pin 92*a*, which is attached to the distal end of the fixed arm 43 of the ribbon guide mechanism, is fitted into the second engaging hole 143. Further, the free end of the supporting shaft 32, the one fixing pin 141, and the other fixing pin 141 engage the third, fourth, and fifth engaging holes 144, 145 and 146, respectively. Moreover, the distal end portion of the fixing plate 140 is pressed against the side plate 54 of the ribbon unit 46 with the bush 148 between them. In this state, the fixing plate 140 is locked to the fixing position by turning the knob 147*a* of the plate 140 so that the lock piece 147*b* engages the upper end portion of the frame side plate 15. As a result, the free end of the supporting shaft 32, which is supported like a cantilever by means of the side plate 14 of the body frame 12, that end of the head frame 31 on the side of the side plate 15, and the free end of the fixed arm 43 are supported by means of the fixing plate 140. Thus, the shaft 32, the frame 31, and the arm 43 are supported at both ends.

That portion of the transfer ribbon 29, set in this manner, which extends from the supply shaft 49 to the take-up shaft 50 is transported past the printing section. When the line thermal head 39 is actuated, therefore, ink of the ribbon 29 is transferred to the labels on the paper, thus effecting printing.

The following is a description of the operation of the ribbon supply device 45 during use of the label printer constructed in this manner. When the platen roller 24 is rotated in association with the operation of the paper feeding mechanism (not shown), the gear 80 of the ribbon drive section 47 is rotated by means of the gear 85. As a result, the timing belt 81 is driven by means of the toothed pulley 79, and the rotating shaft 69 is rotated by means of the gears 76 and 75. Also, the rotating shaft 71 is rotated by means of the toothed pulley 78.

Since the rotating shaft 69 is connected with the ribbon drive shaft 52 of the ribbon unit 46, it rotates in the direction of arrow G of FIG. 3, thereby running the transfer ribbon 29 in contact with the outer circumferential surface thereof. At this time, the take-up shaft 50 is connected to the rotating shaft 71, so that it rotates in the direction of arrow H of FIG. 3, thereby taking up the ribbon 29 transported past the shaft 52.

At this time, moreover, the supply shaft 49 and the tension shaft 51 are driven to rotate by means of the take-up force of the transfer ribbon 29, so that the ribbon 29 is supplied, and a tension is applied to the ribbon 29 by means of the tension shaft 51. In synchronism with the travel of the ribbon 29, the paper also runs in a predetermined direction, and desired information is printed on the labels on the paper by means of the thermal head 39.

When the transfer ribbon 29 is entirely taken up after continued printing, it should be changed.

In this case, the ribbon unit 46 is pulled form the body frame 12 in the manner described above. Thereafter, the respective proximal parts of the hook portions 63 of the bearings 58 and 59 of the ribbon unit 46 ar elastically deformed to disengage the supply shaft 49 and the take-up shaft 50, and these shafts 49 and 50 are removed from the bearings 58 and 19, respectively. Then, the shafts 49 and 50 wound with a new transfer ribbon 29 are mounted on the bearings 59 and 58, respectively, of the unit 46.

Thereafter, the ribbon unit 46 is inserted into the body casing 1 to be set therein in the same manner as aforesaid, whereupon the replacement is finished.

Reuse of the transfer ribbon 29 having ink remaining thereon can be facilitated in the following manner. The ribbon unit 46 is removed from the slider 91 by holding up the handle 56 after it is drawn out from the body casing 1. After the unit 46, which has a symmetrical configuration, is turned 180 degrees around the axis P on the imaginary plane H, it is mounted on the slider 91. Further, the unit 46, along with the slider 91, is inserted into the casing 1 and connected to the ribbon drive section 47. In doing this, the relay cores 102 in the connecting holes 66 formed individually in the respective shaft end portions 49*a*, 50*a*, 51*a* and 52*a* of the shafts 49, 50, 51 and 52 of the ribbon unit 46 are fitted on their corresponding rotating shafts 71, 72, 69 and 70 of the ribbon drive section 47. Thus, the projections 104 of each core 102 engage the grooves between the projections 84 of each of the rotating shafts 69, 70, 71 and 72, so that power transmission from the ribbon drive section 47 to the individual shafts 49 to 52 of the ribbon unit 46 is enabled.

After the printing is continued for a long time, the thermal head 39 should be replaced or cleaned. In such a case, the knob 147*a* of the fixing plate 140 is first turned to unlock the plate 140, and the plate 140 is then rocked from the fixing position to the release position. Thereupon, the fixing plate 140 is disengaged from the supporting shaft 32, the head frame 31, and the fixed arm 43. Then, the platen roller 24 is rocked downward around the support shaft 22, and is disengaged from the thermal head 39.

Subsequently, the screws 135, which are used to fix the head frame 31 to the head supporting plate 128, are removed, and the head unit 30 is then drawn out. Thereupon, the unit 30 slides along the supporting shaft 32, so that it can be taken out to the outside of the frame side plate 15. After the head unit 30 is taken out in this manner, the thermal head 39 is replaced with a new one or cleaned. Thereafter, the head unit 30 is attached to the body frame 12 reversely following the aforesaid steps of procedure. Then, the fixing plate 140 is rocked from the release position to the fixing position, and is locked to the fixing position by means of the lock mechanism 147. Thus, the head unit 30 and the supporting shaft 32 are supported at both ends.

As described above, the printer according to the present embodiment is provided with the supporting mechanism for supporting the ribbon unit on the body frame. By moving the slider of this supporting mechanism, the ribbon unit is moved between a first position where it is connected to the ribbon drive section and a second position where it is separated from the drive section and situated outside the body casing. Accordingly, the ribbon unit can be easily attached to or detached from the ribbon drive section. Also, the transfer ribbon can be replaced outside the casing. Thus, the working efficiency is considerably improved.

When the fixing plate 140 is rocked to the fixing position with the ribbon unit 46 connected to the ribbon drive section 47, moreover, the free end of the fixed arm 43 of the supporting mechanism 44 is supported by the plate 140, and the unit 46 is pushed toward the drive section 47 through the medium of the bush 148. When the ribbon unit 46 is mounted in the printer body, therefore, it can be positioned with reliability. Accordingly, the ribbon unit 46 can be prevented from shaking, and therefore, the transfer ribbon 29 can be prevented from meandering or being wrinkled, during the printing operation. Thus, the print quality can be improved.

According to the printer described above, furthermore, the head unit 30 is slidably supported on the supporting shaft 32, which is supported like a cantilever by means of the one frame side plate, and can be drawn out of the printer body along the shaft 32. Accordingly, the thermal head 39 can be attached to or detached from the head frame 31 with the head unit 30 outside the printer body, so that replacing or cleaning the head is very easy.

After the head unit 30 is slid and set in its operative position in the printer body, the respective free ends of the supporting shaft 32 and the head frame 31 are fixed by means of the fixing plate 140 for use as fixing means. Thus, the shaft 32 and the frame 31 can be supported at both ends. Further, the head frame 31 is pressed against the inner surface of the frame side plate 14 by means of the holding mechanism 125, which is provided at the proximal end portion of the supporting shaft 32, whereby the shaft 32 is prevented from moving in the axial direction. Thus, the thermal head 39 can be prevented from shaking, so that more satisfactory printing can be effected.

Figure 20:
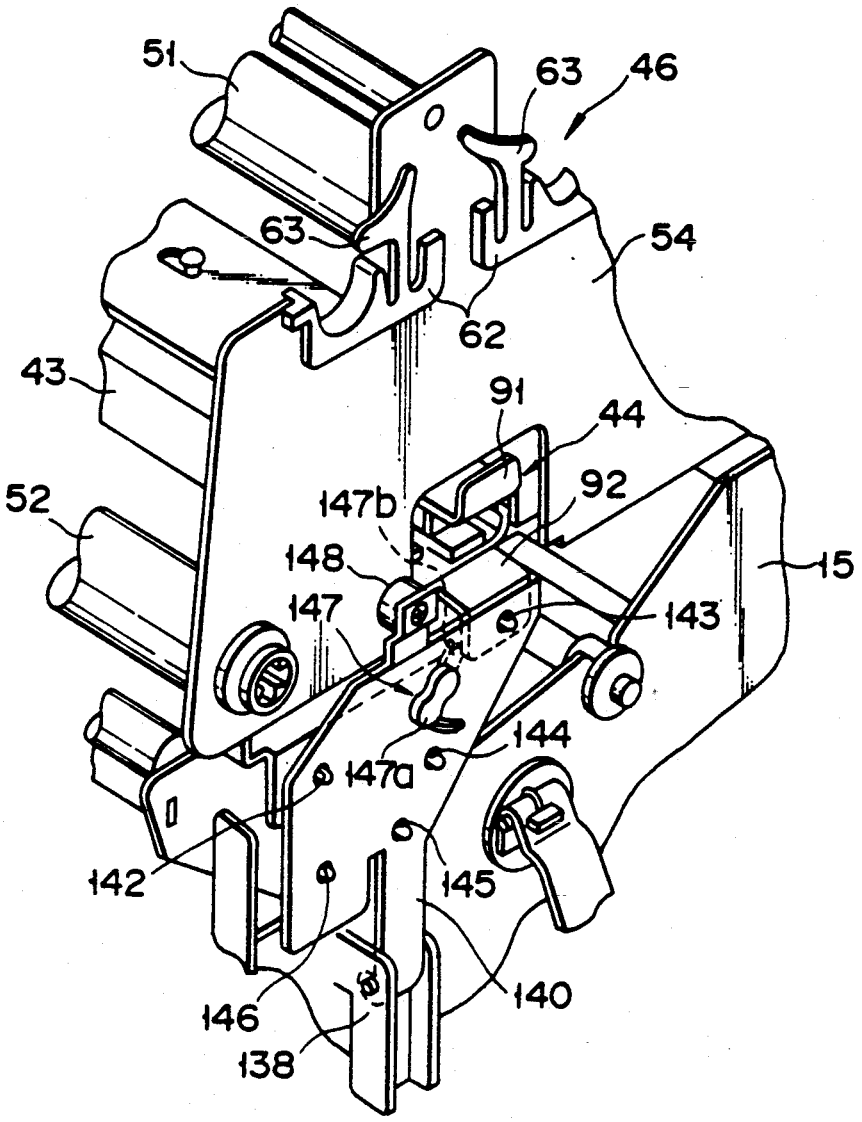
FIG. 20 is a perspective view corresponding to FIG. 17, showing a modification of a lock mechanism.

It is to be understood that the present invention is not limited to the embodiment described above, and that various changes and modifications may be effected therein by one skilled in the art without departing from the scope or spirit of the invention. In the above embodiment, for example, the lock mechanism 147 of the fixing plate 140 is arranged so as to engage the side plate 15 of the body frame 12. Alternatively, however, the lock mechanism may be designed so as to engage a projecting plate 92 provided at the distal end of the fixed arm 43, as shown in FIG. 20.

What is claimed is:

1. A transfer printer comprising:

a main body;

printing means including a print head and a platen facing the print head, which are arranged in the main body, for printing information on a recording medium transported between the print head and the platen;

a ribbon supply device for running a transfer ribbon between the print head and the recording medium, said ribbon supply device including a ribbon unit, having the transfer ribbon and a supply shaft and a take-up shaft wound with the transfer ribbon, and a ribbon drive section attached to the main body, for driving the ribbon unit;

supporting means arranged in the main body, for supporting the ribbon unit so that the ribbon unit is movable between a first position in which the ribbon unit engages the ribbon drive section and a second position in which the ribbon unit is disengaged from the ribbon drive section; and a fixing member provided on the main body so as to be movable between a release position in which the ribbon unit is allowed to move and a fixing position in which the fixing member engage the ribbon unit to hold the ribbon unit in the first position.

2. A printer according to claim 1, wherein said supporting means includes a supporting member, having a fixed end fixed to the main body and a free end and extending substantially parallel to the platen, and a slider carrying the ribbon unit thereon, said slider being mounted on the supporting member so as to be movable between the first and second positions, and said fixing member includes an engaging portion for engaging and supporting the free end of the supporting member when the fixing member is in the fixing position.

3. A printer according to claim 2, wherein said main body includes a supporting frame having first and second side plates facing each other, said fixed end of the supporting member is fixed to the first side plate and said free end of the supporting member is situated close to the second side plate, and said fixing member is arranged on the second side plate so as to be rockable between the fixing position and the release position.

4. A printer according to claim 3, wherein said supporting member includes a projection protruding from the free end thereof, and said fixing member includes an engaging hole for engaging the projection when the fixing member is in the fixing position.

5. A printer according to claim 1, wherein said fixing member includes a pressing portion for pressing the ribbon unit toward the ribbon drive section, when in said fixing position.

6. A printer according to claim 5, wherein said pressing portion includes a bush formed of an elastic material.

7. A printer according to claim 1, wherein said fixing member includes lock means for locking the fixing member in the fixing position.

8. A printer according to claim 7, wherein said lock means includes a lock piece and an operating member for rotating the lock piece, said lock piece being attached to the fixing member so as to be rotatable between a lock position in which the lock piece engages the main body to lock the fixing member in the fixing position, and a release position in which the lock piece is disengaged from the main body.

9. A printer according to claim 1, wherein said ribbon unit is located outside the main body when the ribbon unit is moved to the second position.

10. A printer according to claim 1, which further comprises a head unit, including a head frame fixedly fitted with the print head, and a supporting shaft having a fixed end fixed to the main body and a free end and extending substantially parallel to the platen, said supporting shaft supporting the head unit in an operative position in which the print head is opposed to the platen so that the head unit is movable along the supporting shaft in the longitudinal direction of the platen, from the operative position to the outside of the main body; and wherein said fixing member includes first and second engaging portions for engaging and supporting the free end of the supporting shaft and the head unit when the fixing member is in the fixing position.

* * * * *